US006212776B1

(12) United States Patent
Izumi et al.

(10) Patent No.: US 6,212,776 B1
(45) **Date of Patent: *Apr. 10, 2001**

(54) ELECTRIC SHAVER

(75) Inventors: Shunji Izumi; Tetsuya Ozawa, both of Matsumoto (JP)

(73) Assignee: Izuma Products Company, Nagano (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/805,446

(22) Filed: Feb. 25, 1997

(51) Int. Cl.[7] ..... B26B 19/00
(52) U.S. Cl. ..... 30/43.4; 30/43.5; 30/43.6
(58) Field of Search ..... 30/43.4, 265, 264, 30/43.5, 43.6

(56) References Cited

U.S. PATENT DOCUMENTS

| | | | | |
|---|---|---|---|---|
| 2,283,834 | * | 5/1942 | Van Dam et al. | 30/43.5 |
| 2,308,920 | * | 1/1943 | Horowitz et al. | 30/43.5 |
| 2,742,694 | * | 4/1956 | Stone | 30/43.5 |
| 2,965,966 | * | 12/1960 | Jacobs | 30/43.5 |
| 3,715,803 | * | 2/1973 | Tyler | 30/43.5 |
| 4,089,110 | * | 5/1978 | Rasco | 30/43.6 |
| 5,007,168 | * | 4/1991 | Messinger et al. | 30/43.6 |
| 5,031,315 | * | 7/1991 | Labrijn | 30/43.6 |
| 5,408,749 | * | 4/1995 | Momose | 30/43.6 |

FOREIGN PATENT DOCUMENTS

| | | | | |
|---|---|---|---|---|
| 376798 | * | 5/1964 | (CH) | 30/43.5 |
| 1173817 | * | 7/1964 | (DE) | 30/43.5 |
| 0074684 | | 3/1983 | (EP) . | |
| 913779 | * | 6/1946 | (FR) | 30/43.5 |
| 1192334 | | 10/1959 | (FR) . | |
| 1428943 | * | 1/1966 | (FR) | 30/43.5 |
| 634266 | * | 2/1962 | (IT) | 30/43.5 |

* cited by examiner

*Primary Examiner*—M. Rachuba
(74) *Attorney, Agent, or Firm*—Koda & Androlia

(57) ABSTRACT

An electric shaver having one pair or a plurality of pairs of inner and outer cutting members so that the inner cutting member and outer cutting member are rotated by a single drive source in the same direction or opposite directions relative to each other.

12 Claims, 8 Drawing Sheets

ELECTRIC SHAVER

BACKGROUND OF THE INVENTION

1. Field of the Invention

The present invention relates to an electric shaver and more particularly to an electric rotary shaver.

2. Prior Art

Generally, in electric shavers, particularly in electric rotary shavers, inner cutters are rotated on the under surface of outer cutters; and the hair is cut by the shearing force generated between these two cutters. In some shavers, only one single shaving unit that consists of an inner cutter and an outer cutter is installed in the shaver head of the shaver; and there are also shavers in which two shaving units or three shaving units are installed in the shaver head, each being called a twin-headed shaver and a triple-headed shaver, respectively. In the twin-headed shaver, the shaving units are arranged side by side; and in the three-headed shavers, the shaving units are generally arranged in an inverse equilateral triangle shape so as to obtain the most efficient shaving results.

In any of these shavers currently marketed, only the inner cutters are rotated by a motor installed inside the shaver casing so that the shearing force is obtained between the rotating inner cutter and the non-rotating outer cutter which are designed to be inwardly depressible during shaving.

Since the outer cutter which ordinarily has radial slits for introducing facial hair is not rotated as described above, the hair does not enter into the slits easily, resulting in that shaving is occasionally not performed efficiently. So as to execute a smooth and efficient shave, it is common to move the shaving head (and therefore the outer cutters) circularly on, for example, the face, which sometimes causes muscle fatigue in the arm that holds the shaver; and therefore, such a prior art shaver has a problem with the shaving effect and with the use thereof.

SUMMARY OF THE INVENTION

Accordingly, the primary object of the present invention is to provide an electric shaver that can reduce the necessity of circular movements of the shaver in use, thus ensuring an easy, quick and smooth shave.

It is another object of the present invention to provide an electric shaver having high hair raising and take-in efficiency and hair cutting efficiency by way of a rotatable outer cutter(s) and a rotatable inner cutter(s).

It is still another object of the present invention to provide an electric shaver which includes a rotatable outer cutter(s) which can function as a "comb" so as to smoothly raise and bring the hair into the slits formed on the outer cutter(s) and further between the outer cutter(s) and inner cutter(s), thus ensuring a smooth and quick shave.

The above-described objects of the present invention are accomplished by a unique structure for an electric rotary shaver which includes at least one shaving unit that comprises an outer cutter (outer cutting member) and an inner cutter (inner cutting member) so that not only is the inner cutter rotated but also the outer cutter is rotated via a series of gears provided between a single rotary power source and the shaving unit(s). In other words, according to the electric shaver of the present invention, the outer cutter(s) is provided with a ring gear(s) on, for example, its circumferential surface(s), and this ring gear(s) is meshed with a gear(s) rotated by a transmission gear(s) which is rotated by a drive gear(s) that causes the corresponding inner cutter(s) to rotate.

Furthermore, according to the present invention, the outer cutter(s) and the inner cutter(s) are rotatable not only in the same directions but also in the opposite directions.

DETAILED DESCRIPTION OF THE INVENTION

The present invention will be described in detail below based upon the embodiments with reference to the accompanying drawings.

Figure 1:
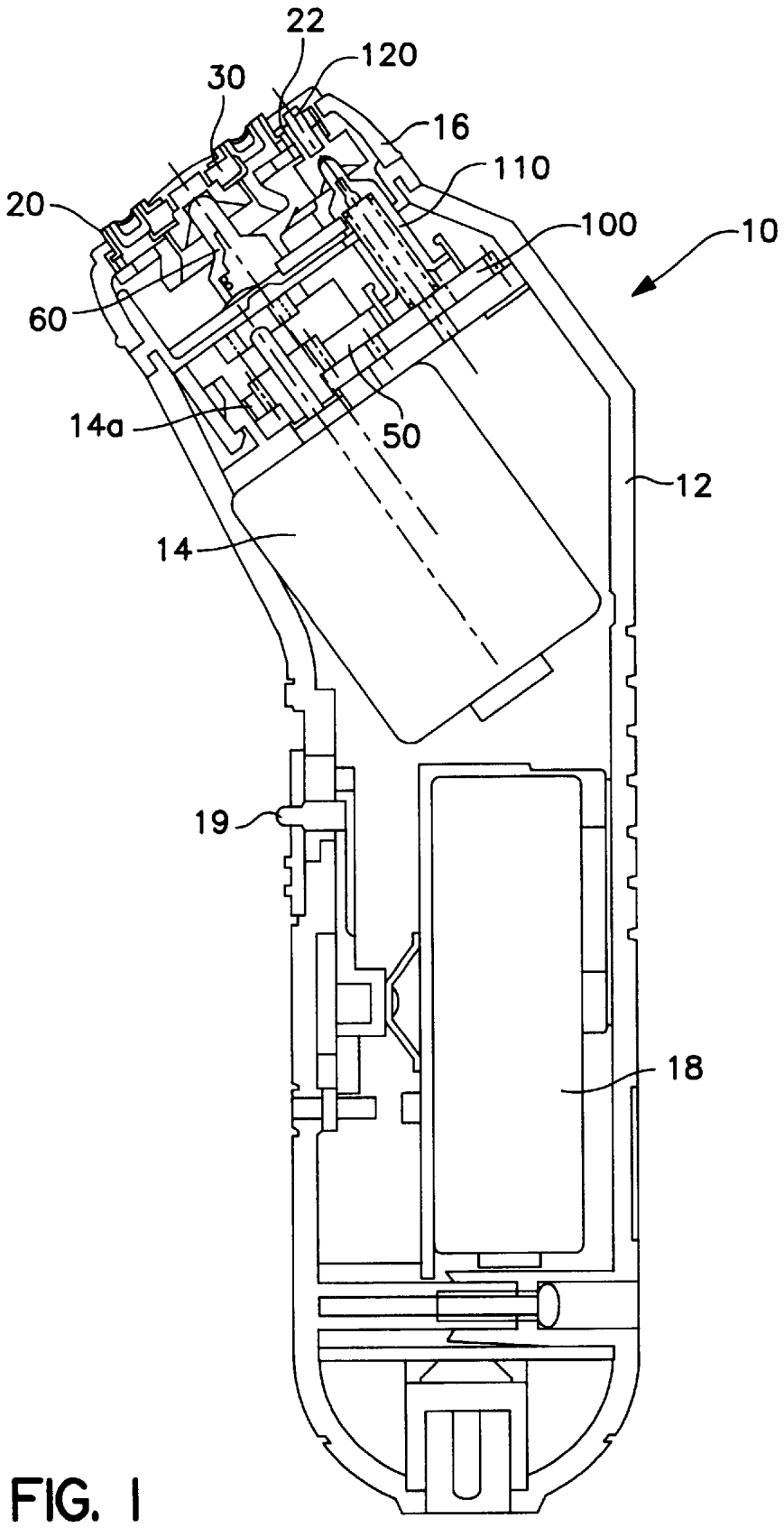
FIG. 1 is an explanatory illustration showing the inside of the first embodiment of the electric shaver according tithe present invention wherein the shaver includes two pairs of inner and outer cutting members.
Figure 2:
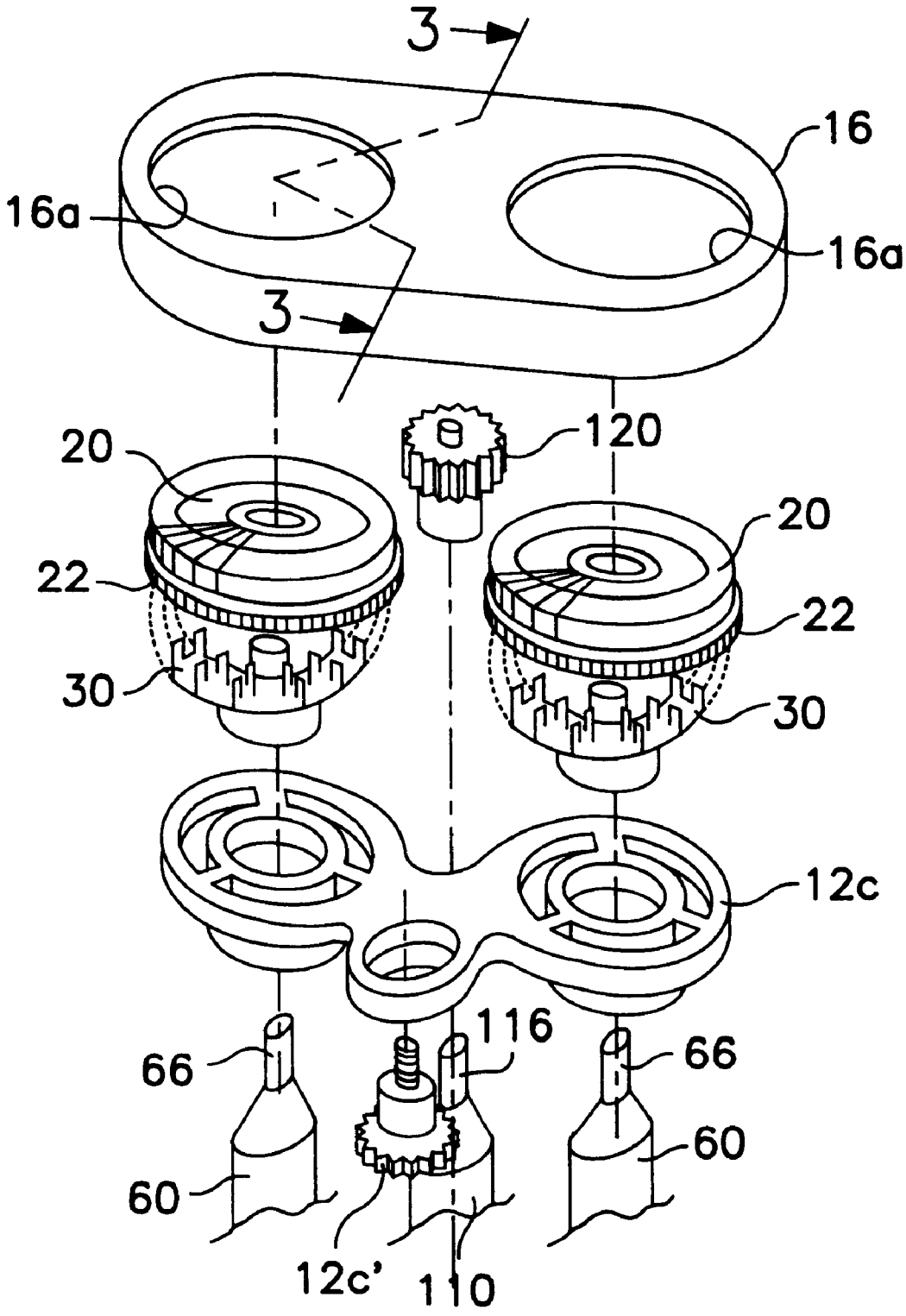
FIG. 2 is an exploded perspective view showing the essential portion thereof.
Figure 3:
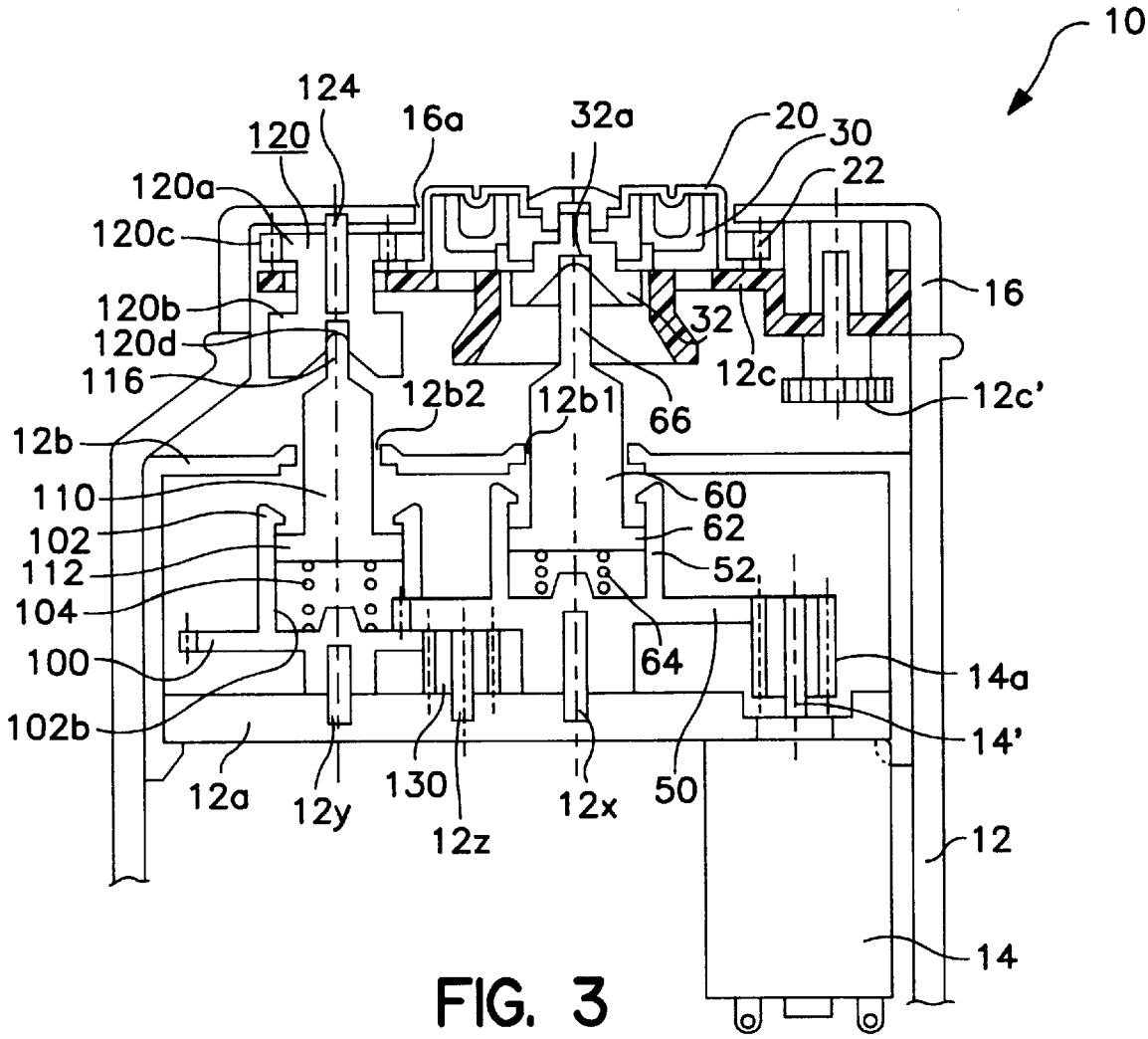
FIG. 3 is an explanatory illustration showing the inside of the essential portion thereof being viewed from the direction of lines 3—3 in FIG. 2.

FIG. 1 shows the inside of the shaver according to the first embodiment of the present invention, FIG. 2 is an exploded perspective view showing the essential portion thereof, and FIG. 3 shows the cross section thereof.

In these Figures, the electric shaver is generally referred to by the reference numeral 10, and it includes a shaver housing 12 and two shaving units each substantially comprising an outer cutting member 20 and an inner cutting member 30. The tip end of the inner cutting member 30 is in contact with an inner surface of a circular top end wall of the outer cutting member 20.

The shaver housing 12 is opened at one end and a removable head frame 16 covers this open end; and the shaver housing 12 is provided therein with a mounting plate 12*a* and a drive shaft holder 12*b*. A cutting member retaining frame 12*c* is detachably mounted to the undersurface of the head frame 16 by way of a fixing screw 12*c*'. Furthermore, a single electric motor 14 that is actuated by an AC and/or DC power source, a battery 18 which actuates the motor 14, and an ON-OFF switch 19 which connects the motor 14 and battery 18 are provided in the shaver housing 12.

Figure 4:
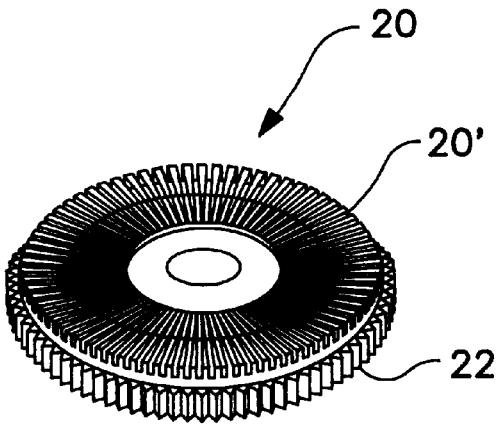
FIG. 4 is a perspective view of an outer cutting member that is employed in the present invention.

The head frame 16 is provided so as to be elastically snap-fitted to the shaver housing 12 in a removable fashion; and each of two outer cutting members 20 is fitted in each of two circular apertures 16*a* opened in the head frame 16. The circular apertures 16*a* are slightly larger in diameter than the outer cutting members 20. Typically, the outer cutting member 20 is, as best shown in FIG. 4, comprised of a shallow cylinder made of metal having the circular top end portion with hair entry apertures 20' that are slits opened radially.

Figure 5A:
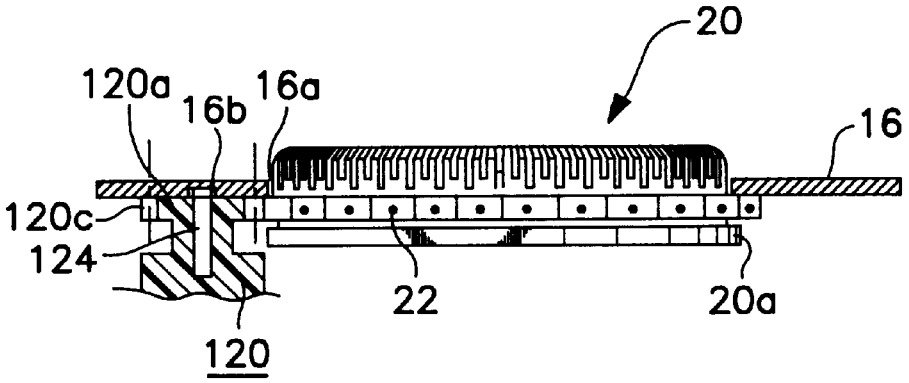
FIG. 5(*a*) is a partially sectional explanatory illustration showing one meshing connection between the gear of an outer cutting member and a gear that rotates the outer cutting member, and FIG. 5(*b*) is a partially sectional explanatory illustration showing another meshing connection between the gear of an outer cutting member and a gear that rotates the outer cutting member.
Figure 5B:
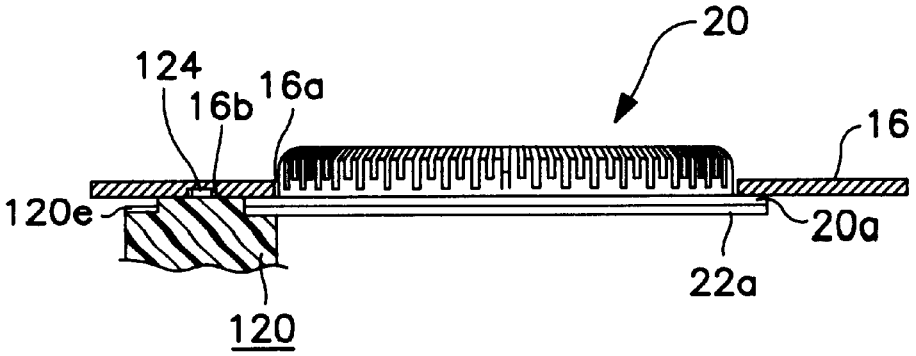

Furthermore, each of the outer cutting members 20 is provided with a ring gear 22. The ring gear 22 is made of, for example, plastic and securely fixed on the outer circumferential surface of the outer cutting member 20 as shown in FIG. 4. As best seen in FIG. 5(*a*), the root area of the outer cutting member 20 is situated on the inner side of the head frame 16 so that the outer cutting member 20 is in a circular aperture 16*a* opened in the head frame 16, and the ring gear 22 of the outer cutting member 20 is located between the flange 20*a* of the outer cutting member 20 and the head frame 16 so that the outer cutting member 20 is prevented from coming off of the head frame 16.

The inner cutting members 30 and outer cutting members 20 are provided between the head frame 16 and the cutting member retaining frame 12*c*; and each of the inner cutting members 30 is, as seen from FIG. 3, positioned inside each of the outer cutting members 20 so that the inner cutting member 30 is (as described below) rotated inside the outer cutting member 20 by the drive motor 14. Two inner cutting members 30 are connected to the motor 14 via a motor shaft gear 14*a*, two primary gear wheels 50, two primary drive shafts 60 and rotation transmission blocks 32 which are attached to the inner cutting members 30. These elements for rotating the inner cutting members 30 are referred to as an inner cutting member drive assembly.

More specifically, the motor 14, secured to the mounting plate 12*a*, has a motor shaft gear 14*a* on its output shaft 14', and this motor shaft gear 14*a* is meshed with two primary gear wheels 50 (only one is shown in FIG. 3). Each of the primary gear wheels 50 is rotatably journalled on a primary spindle 12*x* (only one shown) which is fixed in the mounting plate 12*a*. Each of the primary gear wheels 50 has a hollow hub 52 at the center which has a cavity inside so as to accommodate a flange 62 of each of two primary drive shafts 60 (only one shown) which has a hollow bore inside. The flange 62 formed at one end of the primary drive shaft 60 is coupled to the inside of the hollow hub 52 of the primary gear wheel 50 so that the primary drive shaft 60 is coaxially coupled to the primary gear wheel 50 and rotated thereby. A coil spring 64 is provided inside the hollow bore of each of the primary drive shafts 60 so as to be compressed between the primary drive shafts 60 and the primary gear wheels 50, thus pressing the primary drive shaft 60 towards the head frame 16. Accordingly, the outer flange 20*a* of the outer cutting member 20 is urged towards the head frame 16 by the coil spring 64; and when the shaver is in use, the outer cutting member 20 can be depressed, against the driving force of the coil spring 64, toward the inside of the shaver housing 12 together with the inner cutting member 30 and primary drive shaft 60.

In other words, the outer cutting members 20, the inner cutting members 30 and the primary drive shafts 60 are depressible in the direction toward the mounting plate 12*a* during the use of the shaver; and each of the primary drive shafts 60 is able to make a swivel motion because of the spaces between the outer surface of the primary drive shaft 60 and the inner surfaces of the hollow hub 52 and because of the spaces between a first shaft hole 12*b*1 of the drive shaft holder 12*b* and the surface of the primary drive shaft 60. Thus, it is facilitated that a coupling tongue 66 formed at other end of each primary drive shafts 60 engages the engagement hole 32*a* of the rotation transmission block 32 attached to each inner cutting member 30.

Furthermore, a single secondary gear wheel 100 is rotatably journalled on a secondary spindle 12*y* which is fixed in the mounting plate 12*a*. The secondary gear wheel 100 is, like the primary gear wheels 50, provided with a hollow hub 102 at the center which has a cavity inside so as to accommodate the flange 112 of the secondary drive shaft 110 which has a hollow bore inside. This flange 112 formed at one end of the secondary drive shaft 110 is coupled to the inside of the hollow hub 102 of the secondary gear wheel 100 so that the secondary drive shaft 110 is coaxially coupled to the secondary gear wheel 100 and rotated by the secondary gear wheel 100. A secondary coil spring 104 is provided inside the hollow bore of the secondary drive shaft 110 so that the secondary coil spring 104 can be compressed between the secondary drive shaft 110 and the secondary gear wheel 100 and presses the secondary drive shaft 110 in the direction toward the head frame 16. The secondary drive shaft 110 has a coupling tongue 116 at its other end which is engaged with a tip end gear 120.

The tip end gear 120 comprises a gear portion 120*a* and rotation transmission portion 120*b* and is provided so that the gear portion 120*a* is located between the head frame 16 and the cutting member retaining frame 12*c*. The tip end gear 120 has a pin 124 that engages a recess 16*b* (see FIG. 5(*a*)) formed in the inner surface of the head frame 16 so as to allow end the gear 120 to be rotatable; and the gear tooth 120*c* formed on the gear portion 120*a* of the tip end gear 120 is meshed with the ring gears 22 that are attached to the outer cutting members 20, and the rotation transmission portion 120*b* is engaged with the coupling tongue 116 of the secondary drive shaft 110 via an engagement hole 120*d* formed in the rotation transmission portion 120*b* so that the tip end gear 120 is rotated by the secondary drive shaft 110.

In the above structure, because of the presence of the second coil spring 104, the secondary drive shaft 110 can make a swivel motion by way of a space between the outer surface of the secondary drive shaft 110 and the inner surface 102*b* of the hollow hub 102 and a space between the outer circumference of the secondary drive shaft 110 and the inner surface of a secondary shaft hole 12*b*2 of the drive shaft holder 12*b*. Thus, the coupling tongue 116 of the secondary drive shaft 110 easily can engage the engagement hole 120*d* of the rotation transmission portion 120*b* of the tip end gear 120.

In the embodiment above, as shown in FIG. 5(*a*), the ring gear 22 is provided on the outer circumferential surface of the outer cutting member 20 and meshed with the gear 120*c* circumferentially formed on the tip end gear 120. However, as shown in FIG. 5(*b*), the outer cutting member 20 may have a ring gear 22*a* on the under end surface so that the ring gear 22*a* is meshed with an annular gear tooth 120*e* formed on the upper end surface of the tip end gear 120.

Furthermore, a transmission spindle 12*z* is fixed to the mounting plate 12*a*, and a transmission gear 130 is rotatably journalled on this transmission spindle 12*z*. The transmission gear 130 is provided between one of two primary gear wheels 50 and the secondary gear wheel 100 and meshed with these gear wheels 50 and 100 so that the rotation of one of the two primary gear wheels 50 rotates the transmission gear 130 and the rotation of the transmission gear 130 rotates the secondary gear wheel 100.

The secondary gear wheel 100, the secondary drive shaft 110 and the tip end gear 120 provided adjacent to the inner cutting member drive assembly described above are referred to as an outer cutting member drive assembly.

Figure 6:
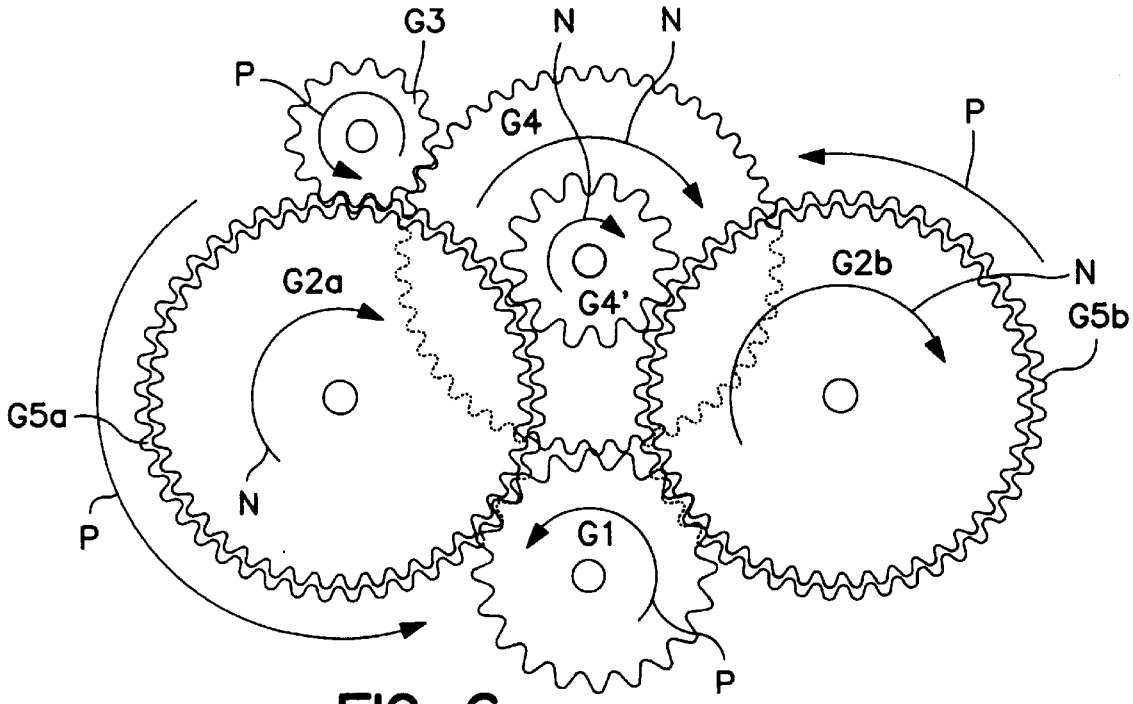
FIG. 6 is a plan view showing the gear arrangement employed in the first embodiment of the present invention.

FIG. 6 shows the gear arrangement employed in the above embodiment, and it particularly shows the motor gear 14*a*', two primary gear wheels 50, transmission gear 130, secondary gear wheel 100, tip end gear 120 and two ring gears 22 provided on the outer cutting members 20.

As seen from FIG. 6, the gear G1 (which corresponds to the motor shaft gear 14*a* in FIGS. 2 and 3) is meshed with two gears G2*a* and G2*b* (each corresponding to the two primary gear wheels 50) which are installed side by side. The gear G3 (which corresponds to the transmission gear 130 in FIGS. 2 and 3) is meshed with one (G2*a*) of the two gears G2*a* and G2*b* and also with the gear G4 (which corresponds to the secondary gear wheel 100 in FIGS. 2 and 3). The gear G4' (which corresponds to the tip end gear 120) is provided on the same axis as the gear G4 (with the secondary drive shaft 110 in between), and the gear G4' is meshed with two gears G5*a* and G5*b* (each corresponding to the ring gears 22 attached to the two outer cutting members 20 in FIGS. 2 and 3).

With the gear arrangement described above, when the gear G1 (motor shaft gear 14*a*) is rotated by the motor in one direction P, the gears G2*a* and G2*b* (primary gear wheels 50) which are meshed with the gear G1 are rotated in another (or opposite) direction N. In other words, the inner cutting members that are rotated by the primary gear wheels 50 (gears G2*a* and G2*b*) are rotated in the direction N. On the other hand, when the gear G2*a* is thus rotated in the direction N, the gear G3 (transmission gear 130) meshed with the gear G2*a* is rotated in the direction P; as a result, the gear G4 (secondary gear wheel 100) meshed with the gear G3 is rotated in the direction N. Since the gear G4' (tip end gear 120) is axially provided on the gear G4, the gear G4' is rotated in the direction N; and when the gear G4' is thus rotated in the direction N, the two gears G5*a* and G5*b* (ring gears 22) which are meshed with the gear G4' are rotated in the direction P. In other words, the two outer cutting members that have the ring gears 22 (gears G5*a* and G5*b*) are rotated in the direction P by the end gear 120 (gear G4').

With the structure described above, the two inner cutting members are rotated in one direction N, and the two outer cutting members are rotated in another or opposite direction P. In other words, the inner cutting members and the outer cutting members are rotated in different or opposite directions from each other.

Figure 7:
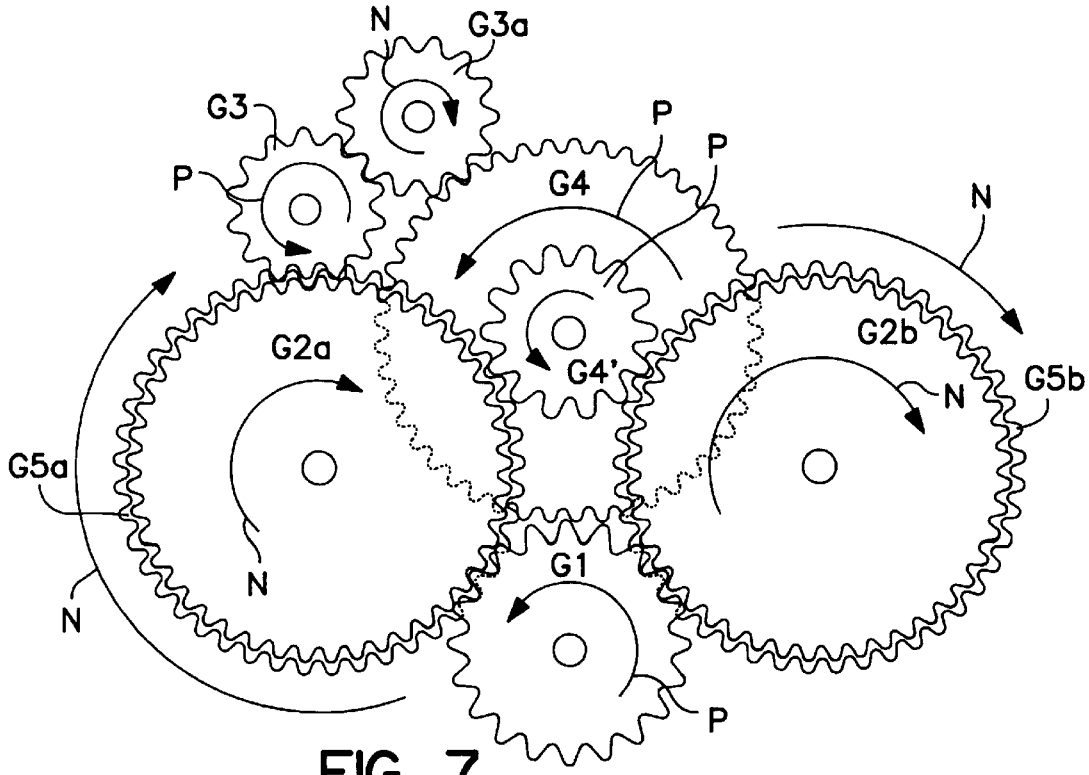
FIG. 7 is a plan view showing the gear arrangement which is different from the one employed in the first embodiment shown in FIG. 6.

FIG. 7 shows a modification of the above embodiment; and in this embodiment of FIG. 7, the inner and outer cutting members are rotated in the same direction.

As seen in FIG. 7, an auxiliary transmission gear G3*a* is interposed between and meshed with gear G3 (corresponding to the transmission gear 130) and the gear G4 (corresponding to the secondary gear wheel 100), so that the rotation of gear G3 is transmitted to the gear G4 via the auxiliary transmission gear G3*a*.

Accordingly, unlike the embodiment shown in FIGS. 2 and 3, when the gear G3 (transmission gear 130) is rotated in the direction P by the gear G2*a* (primary drive gear 50), the gear G4 (secondary gear wheel 100) is rotated in the direction P by the presence of the auxiliary transmission gear G3*a* which is rotated in the direction N by the gear G3, and the gear G4' (tip end gear 120) provided axially on the gear G4 is also rotated in the P direction. As a result, the gears G5*a* and G5*b* (ring gears 22) of the outer cutting members 20, which are meshed with the gear G4' rotating in the direction P, are rotated in the direction N. Thus, the two outer cutting members that have ring gears 22 (gears G5*a* and G5*b*)are rotated in the direction N which is the same rotational direction of the two inner cutting members.

As seen from the above, the shaver according to the above embodiment that has two pairs of inner and outer cutting members has a structure that comprises:

- a shaver housing provided therein with a single motor which has a motor gear attached to an output shaft thereof;
- a mounting plate provided inside the shaver housing;
- two primary gear wheels rotatably provided, side by side, on the mounting plate and meshed with the motor gear so as to be rotated in one direction by the motor gear;
- two primary drive shafts coaxially coupled to the primary gear wheels so as to be rotated in one direction by the primary gear wheels;
- two inner cutting members coupled to the primary drive shafts so as to be rotated by the primary drive shafts in one direction;
- a transmission gear rotatably provided on the mounting plate and meshed with one of two primary gear wheels so as to be rotated thereby in another direction which is opposite from one direction;
- a secondary gear wheel rotatably provided on the mounting plate and meshed with the transmission gear so as to be rotated thereby in one direction;
- a secondary drive shaft coaxially coupled to the secondary gear wheel so as to be rotated in one direction by the secondary gear wheel;
- a tip end gear coupled to the secondary drive shaft so as to be rotated thereby in one direction; and
- two outer cutting members provided so that each one of two inner cutting members is situated in each one of two outer cutting members, each of the outer cutting members being provided thereon with a ring gear which is meshed with the tip end gear so as to be rotated in another direction;
- and therefore, it is possible to rotate two outer cutting members and two inner cutting members in the opposite direction; and, alternately, with an addition of an auxiliary transmission gear, it is also possible to rotate two outer cutting members and two inner cutting members in the same direction.

Figure 8:
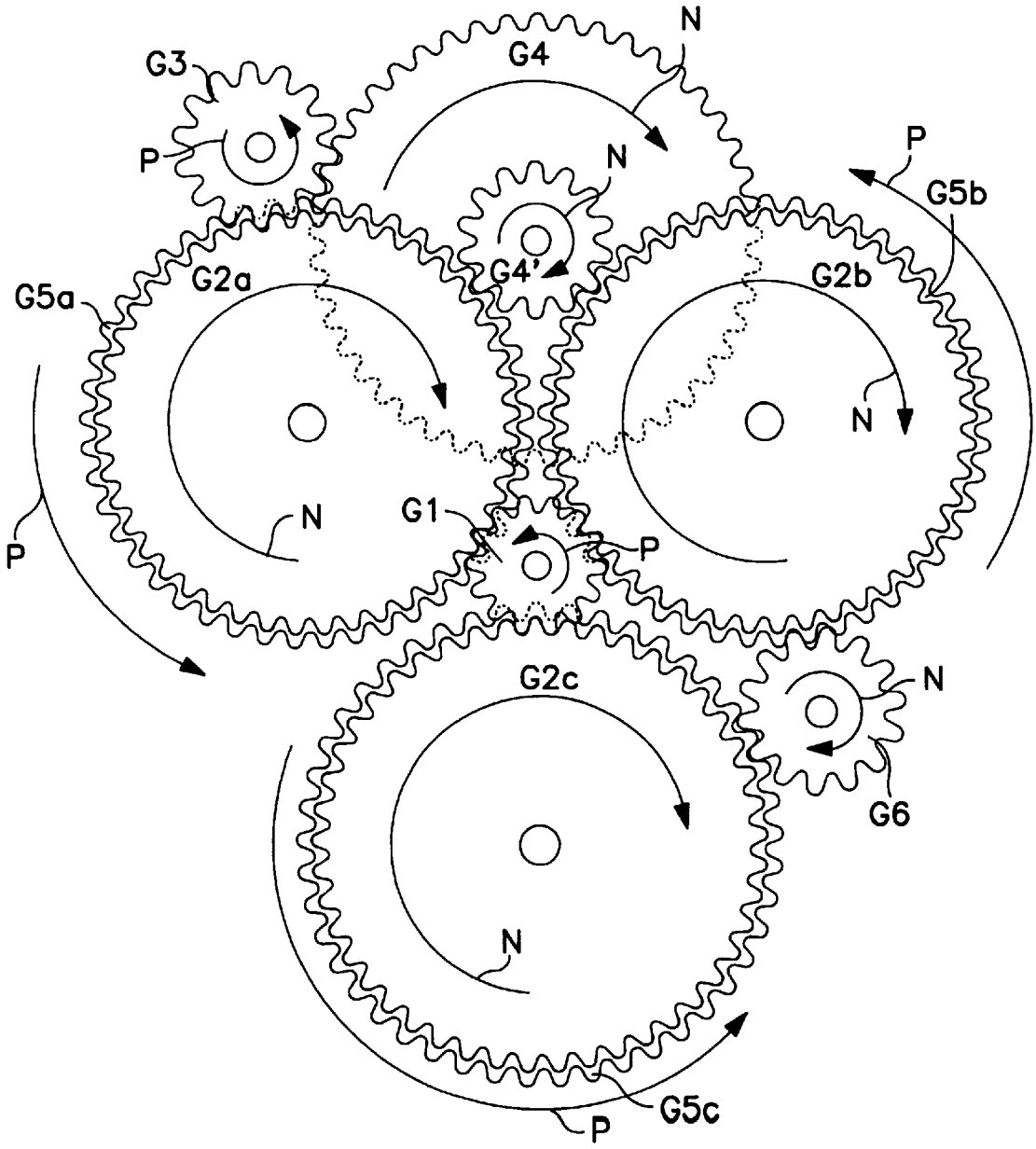
FIG. 8 is a plan view showing the gear arrangement employed in the second embodiment of the present invention in which the shaver includes three pairs of inner and outer cutting members.

FIG. 8 shows the gear arrangement employed in the second embodiment of the present invention.

In this embodiment, three pairs of outer and inner cutting members are installed in an equilateral triangle (inverse equilateral triangle) configuration; and three inner cutting members are rotated in one direction and three outer cutting members are rotated in another direction which is opposite thereto. The basic structure of the second embodiment is the same as the first embodiment described above, and the second embodiment is an extension of the basic structure of FIGS. 2 and 3 from a two cutter system to three cutter system; accordingly, the second embodiment will be described with reference only to the gear engagement shown in this FIG. 8.

As seen from FIG. 8, the gear G1 (which represents a motor shaft gear 14*a* in FIGS. 2 and 3) is provided at the center of three gears G2*a*, G2*b* and G2*c* (each representing primary gear wheel 50 in FIGS. 2 and 3) which are arranged in an inverse equilateral triangle shape and meshed therewith. The gear G3 (which represents a transmission gear 130 in FIGS. 2 and 3) is meshed with the gear G2*a* and also with gear G4 (which represents a secondary gear wheel 100 in FIGS. 2 and 3). Gear G4' (which represents a tip end gear 120 in FIGS. 2 and 3) is provided on the same axis as the gear G4 so as to be rotated thereby, and the gear G4' is meshed with two gears (G5*a* and G5*b*) of the three gears G5*a*, G5*b* and G5*c* (each representing the ring gears 22 of the three outer cutting members 20 in FIGS. 2 and 3) which are arranged, like the three gears G2*a*, G2*b* and G5*c*, in an inverse equilateral triangle shape.

Figure 9:
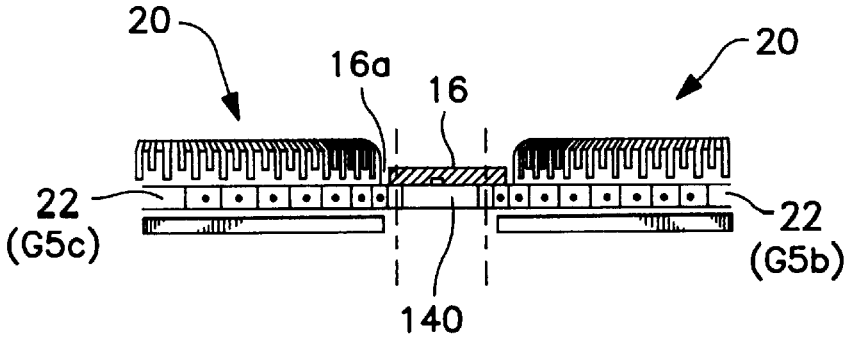
FIG. 9 is a sectional explanatory illustration showing the meshing connection between the gear of one of three outer cutting members and a relay gear that rotates the outer cutting member employed in the second embodiment of the present invention.

In this second embodiment, a relay gear G6 is additionally provided so as to mesh with the gear G5*b* and a gear G5*c*. In other words, the gear G6 is rotatably provided on the undersurface of the head frame 16 as shown in FIG. 9 by way of the reference numeral 140 and is meshed with one (G5*b*) of two gears (G5*a* and G5*b*) and the remaining gear G5*c* (ring gear 22).

Accordingly, when the gear G1 (motor gear) is rotated by the motor in one direction P, the gears G2*a*, G2*b* and G2*c* (primary wheel gears 50) which are meshed with the gear G1 are all rotated in another (or opposite) direction N. In other words, the three inner cutting members are rotated in the direction N. On the other hand, when the gear G2*a* is thus rotated in the direction N, the gear G3 (transmission gear 130) meshed therewith is rotated in the direction P; as a result, the gear G4 (secondary gear wheel 100) meshed with the gear G3 is rotated in the direction N. Since the gear G4' (tip end gear 120) is on the same axis as the gear G4, the gear G4' is rotated in the direction N. When the gear G4' is thus rotated in the direction N, gears G5*a* and G5*b* (ring gears 22) which are meshed with the gear G4' is rotated in the opposite direction P. When the gear G5*b* is thus rotated in the direction P, the gear G6 (relay gear 140) meshed therewith is rotated in the direction N; as a result, the gear G5*c* which is meshed with the gear G6 (ring gear 22) is rotated in the direction P. In other words, the gears G5*a*, G5*b* and G5*c* are all rotated in the direction P, and the three outer cutting members having the ring gears 22 that correspond to the gears G5*a*, G5*b* and G5*c* are all rotated in the direction P.

With the structure described above, in this second embodiment, the three inner cutting members are rotated in one direction N, and the three outer cutting members are rotated in another direction P. In other words, the inner cutting members and the outer cutting members are rotated in different or opposite directions from each other.

Figure 10:
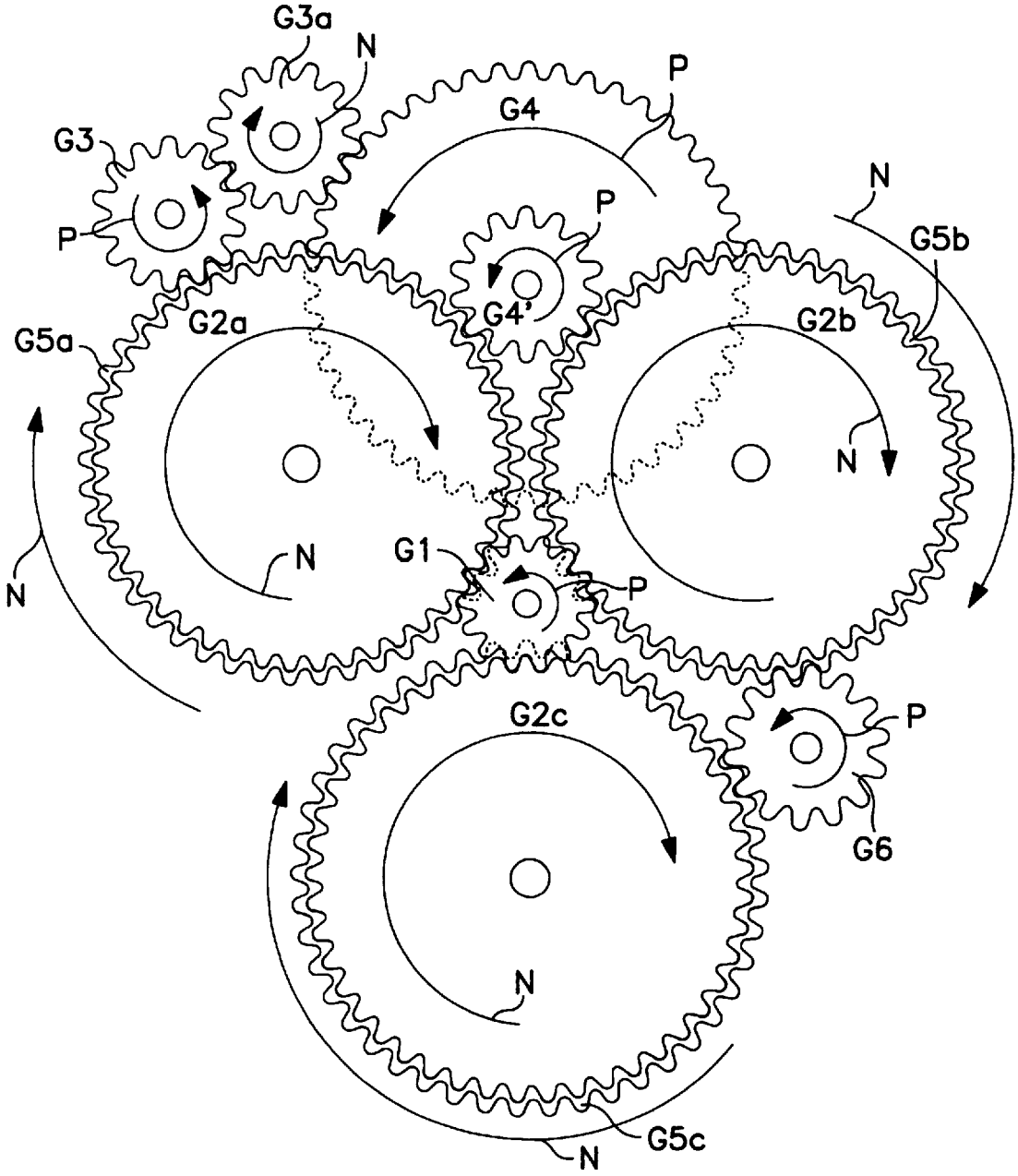
FIG. 10 is a plan view showing the gear arrangement which is different from the one employed in the second embodiment shown in FIG. 8.

The embodiment shown in FIG. 10 includes, in addition to the structure of FIG. 8, an auxiliary transmission gear G3*a* is provided between the gear G3 (transmission gear) and gear G4 (secondary gear wheel) so that the auxiliary transmission gear G3*a* is meshed with these gears G3 and G4.

Accordingly, when the gear G3 (transmission gear 130) is rotated in the direction P, the auxiliary transmission gear G3*a* is rotated in the direction N which causes the gear G4 (secondary gear wheel) to rotate in the direction P so that the gears G5*a* and G5*b* (ring gears 22), which are provided on the outer cutting members and meshed with the gear G4, are rotated in the direction N by the gear G4' which is rotated by the gear G4. Since the gear G5*b* is thus rotated in the direction N, the relay gear G6 is rotated in the direction P which causes the remaining gear G5*c* (ring gear 22) provided on the outer cutting member to rotate in the direction N.

Thus, three inner cutting members and three outer cutting members are rotated in the same direction N.

As seen from the above, the shaver having three inner cutting members and three outer cutting members has a structure that comprises:

- a shaver housing containing therein a single motor which has a motor gear attached to an output shaft thereof;
- a head frame provided at one end of the shaving housing;
- a mounting plate provided inside the shaver housing;
- three primary gear wheels rotatably provided on the mounting plate and meshed with the motor gear so as to be rotated in one direction by the motor;
- three primary drive shafts, each being coaxially coupled to each one of the three primary gear wheels so as to be rotated in one direction by the primary gear wheels;
- three inner cutting members, each being coupled to each one of the three primary drive shafts so as to be rotated in one direction by the primary drive shafts;
- a transmission gear rotatably provided on the mounting plate and meshed with one of three primary gear wheels so as to be rotated thereby in another direction which is opposite from one direction;
- a secondary gear wheel rotatably provided on the mounting plate and meshed with the transmission gear so as to be rotated thereby in one direction;
- a secondary drive shaft coaxially coupled to the second gear wheel so as to be rotated thereby in one direction;
- an end gear coupled to the second drive shaft so as to be rotated thereby in one direction;
- a relay gear provided on the head frame; and
- three outer cutting members provided so that each one of three inner cutting members is situated in each one of three outer cutting, the three cutting members being provided with ring gears, respectively, the ring gears provided on two of the three outer cutting members being meshed with the end gear being rotated in another direction by the end gear; and the ring gear provided on a remaining one of the three outer cutting members being meshed with the relay gear which is meshed with the ring gear provided on either one of the two of the three ring gears,
- therefore, it is possible to rotate three outer cutting members and three inner cutting members in the opposite direction; and, alternately, with an addition of an auxiliary transmission gear, it is possible to rotate three outer cutting members and three inner cutting members in the same direction.

Figure 11:
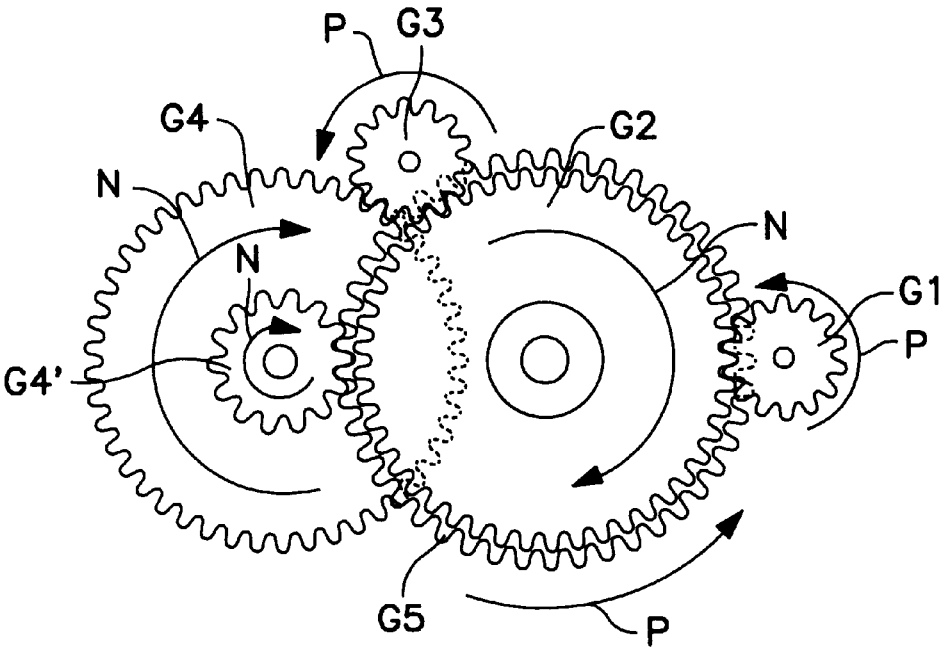
FIG. 11 is a plan view showing the gear arrangement employed in the third embodiment of the present invention in which the shaver includes one pair of inner and outer cutting members.

FIG. 11 schematically shows the gear arrangement of the third embodiment of the present invention in which one inner cutting member and one outer cutting member are provided so as to rotated in the same direction. The basic structure of the third embodiment is the same as the first and second embodiments described above and has a simplified structure compared to a two or three cutter system. Accordingly, the third embodiment will be described with reference only to the gear engagement shown in this FIG. 11.

More specifically, when the motor activated, the gear G1 or motor shaft gear 14*a* is rotated in one direction P; and since the gear G2 (representing a primary gear wheel 50) is meshed with this gear G1 (motor shaft gear 14*a*), the gear G2 is rotated in another (or opposite) direction N. Accordingly, the inner cutting member that is connected to a first drive shaft which is coaxially coupled to the gear G2 is rotated in the direction N by the gear 2 (primary gear wheel 50).

Meanwhile, when the gear G2 (the primary gear wheel 50) is rotated by the gear G1 (motor shaft gear 14*a*) in the direction N as described above, the gear G3 (representing a transmission gear 130) meshed with this gear G2 is rotated in the direction P; and therefore, the gear G4 (representing a secondary gear wheel 100) which is meshed with this gear G3 is rotated in the direction N, and the gear G4' (representing a tip end gear 120) coupled to the gear G4 via the secondary drive gear (110) is rotated in the direction N. As a result, gear G5 or the ring gear 22 of the outer cutting member which is meshed with the gear G4' (tip end gear 120) is rotated in the direction P, and the outer cutting member to which the gear G5 or the ring gear 22 is attached is rotated in the direction P.

As seen from the above, the inner cutting member is rotated in one direction N, and the outer cutting member is rotated in another or opposite direction P. In other words, the inner cutting member and the outer cutting member are rotated in different or opposite directions from each other.

Figure 12:
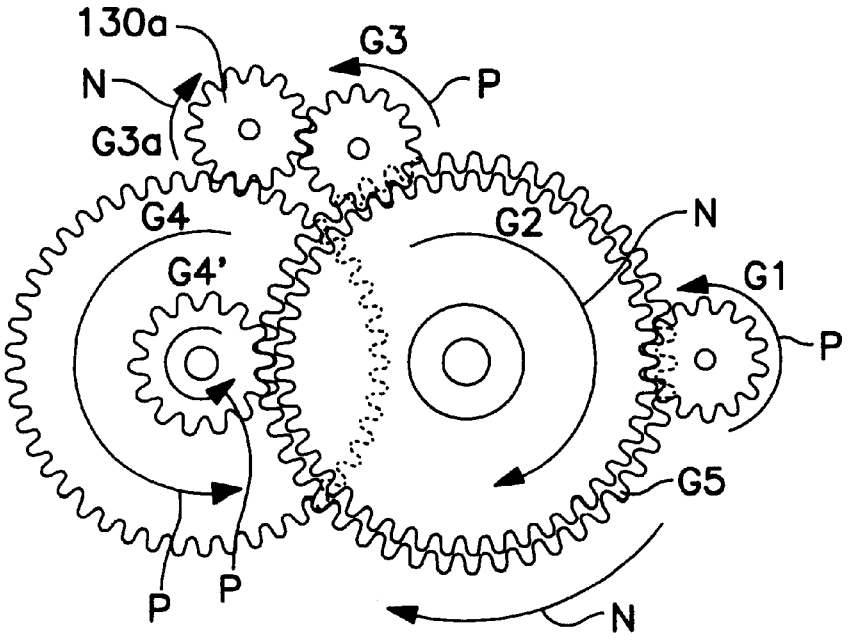
FIG. 12 is a plan view showing the gear arrangement which is different from the one employed in the third embodiment shown in FIG. 11.

FIG. 12 shows a modification of the third embodiment shown in FIG. 11; and in this modified embodiment, the inner cutting member and the outer cutting member are rotated in the same direction.

More specifically, as seen from FIG. 12, an auxiliary transmission gear G3 (130*a*) is additionally provided between the gear G3 (transmission gear 130) and gear G4 (secondary gear wheel 100) so that the rotation of the gear G3 is transmitted to the gear G4 via the auxiliary transmission gear G3*a*.

Accordingly, unlike the embodiment of FIG. 11, the gear G4 (secondary gear wheel 100) is rotated in the direction P when the gear G3 (transmission gear 130) is rotated in the direction P because of the presence of the auxiliary transmission gear G3*a* (130*a*), and so is the gear G4' (tip end gear 120). Thus, the gear G5 or the ring gear 22 of the outer cutting member that meshes the gear G4' (tip end gear 120) is rotated in the opposite direction N, and the inner cutting member is, therefore, rotated in the direction N, which is the same rotational direction of the outer cutting member.

In any of the above embodiments, it should be noted that the tooth shapes of the gears, the sizes or the diameters of the gears, and the number of teeth of each one of the gears shown in FIGS. 1 through 12 are merely illustrative for explanation purposes and do not represent the gear elements (such as the shapes of the gears and teeth, the sizes or the diameters of the gears, the gear ratio, the number of gear teeth, meshing configurations, etc.) of each one of the gears utilized in actual products. It is contemplated that any gear ratio and number of rotations of the inner and outer cutting members can be employed so as to secure the best shaving result. In addition, though the outer cutting member(s) and the inner cutting member(s) can be rotated by different rotational numbers, it is preferable that the outer cutting member(s) be rotated slower than the inner cutting member (s). For instance, when the inner cutting member(s) is rotated at a speed of 2500±500 (or 2,000–3,000) rpm, it is desirable to set the outer cutting member(s) to be at a speed of less than 100 rpm, preferably at a speed of 40–80 rpm. In other words, a good shaving effect can be obtained when the inner cutting member(s) and the outer cutting member(s) are rotated at a rotational ratio of approximately 42:1.

Furthermore, in any of the above embodiments, the transmission gear 130 (or gear G3) is rotated by the primary gear wheel(s) 50 (gear(s) G2, G2*a*, G2*b* G2*c*) so as to rotate the secondary gear wheel 100 (or gear G4) which rotates the outer cutting member(s) 20 via the secondary drive gear 110, tip end gear 120 (gear G4') and ring gear(s) 22 (gear(s) G5, G5*a*, G5*b*, G5*c*)). However, it can be designed so that the transmission gear 130 (G3) is directly rotated by the motor 14. In this case, the transmission gear 130 (G3) is coupled to the output shaft 14' of the motor 14 (instead of being rotatably journalled on the transmission spindle 12*z*) and meshed with the primary gear wheel(s) 50 and the secondary gear wheel 100 so as to rotate the primary and secondary drive shafts 60 and 110; in addition, a gear that corresponds to the motor shaft gear 14*a* (G1) is rotatably provided on the mounting. plate 12*a* and meshed with the primary gear wheel(s) 50. With this structure, the same function and effect as the above embodiments is obtainable.

As seen from the above, according to the present invention, not only the inner cutting member(s) but also the outer cutting member(s) are rotated by a single power source, and, in addition, these inner cutting member(s) and outer cutting member(s) are rotated in the same direction or in the opposite directions. Accordingly, the rotating outer cutting member(s) can raise the lying hair to introduce the raised hair into the slits (hair entry apertures) of the outer cutting member(s), so that shaving can be done extremely easily, efficiently and smoothly.

What is claimed is:

1. An electric rotary shaver comprising three outer cutting members and three inner cutting members, and a single power source for constantly rotating both said outer and said inner cutting members 360° about a central axis of said outer and inner cutting members with both of said three outer cutting members rotating in a same direction and both of said three outer cutting members rotating in a same direction; and wherein:

each of said three outer cutter members is provided with a gear means on an outer circumferential surface thereof;

each of said three inner cutting members is situated in a respective one of said three outer cutting members via a cutting member retaining frame provided in a head frame detachably mounted to a shaver housing of said shaver;

said three inner cutting members are rotated by first drive means which are driven by said single drive source;

said three outer cutting members are rotated by second drive means which are driven by said single drive source;

each of said three outer cutting members is independently depressible in a direction along said central axis of each of said three outer cutting members;

a rotation transmission means is provided between said first drive means and said second drive means; and second drive means comprises a gear wheel meshed with said rotation transmission means, a drive shaft coaxially connected to said gear wheel and an end gear connected to said drive shaft and meshed with the gear means provided on said three outer cutting members.

2. An electric shaver according to claim 1, wherein said at least one outer cutting member and said at least one inner cutting member are rotated in different directions.

3. An electric shaver according to claim 1 or 2, wherein said at least two outer cutting members are rotated at a slower rotational speed than said at least two inner cutting members.

4. An electric shaver according to claim 3, wherein said at least two outer cutting members are rotated at a speed of 100 rpm or less.

5. An electric shaver according to claim 3, wherein said at least two inner cutting members and said at least two outer cutting members are rotated at a rotational ratio of approximately 42:1.

6. An electric shaver according to claim 1, further comprising a spring means provided between said gear wheel and said drive shaft of said second drive means.

7. An electric shaver according to claim 6, further comprising a drive shaft holding means provided in said shaver housing, said drive shaft holding means for supporting said drive shaft of said secondary drive means such that said drive shaft is able to swivel.

8. An electric shaver according to claim 3, wherein said at least two outer cutting members are rotated by a drive means which is actuated by said single power source, said drive means being able to swivel.

9. An electric rotary shaver comprising:

a shaver housing provided therein with a single rotational power source;

a head frame attached to one end of said shaver housing, said head frame being provided with three outer cutting members and three inner cutting members which are each rotatable inside one of said three outer cutting members, said three outer cutting members being provided with gear teeth thereon;

first drive means provided inside said shaver housing and rotated by said rotational single power source so as to cause said tree inner cutting members to rotate;

second drive means provided inside said shaver housing and rotated by said single rotational power source so as to cause said three outer cutting members to constantly rotate 360° about a central axis of each one of said three outer cutting members;

a means for mounting each of said outer cutting head members in said head frame such that each is indpendently depressible in a direction along said central axis of each of said three outer cutting members;

said three outer cutting members rotating in a same direction and said three inner cutting members rotating in a same direction; and a relay gear means is provided on said head frame so as to mesh with said gear teeth provided on two of said three outer cutting members.

10. An electric shaver according to claim 9, wherein said at least one inner cutting member is rotated in one direction and said at least one outer cutting member is rotated in another direction.

11. An electric shaver according to claim 9, wherein said at least two inner cutting members are rotated in two direction and said at least one outer cutting members are rotated in said one direction.

12. An electric rotary shaver comprising:

a shaver housing provided therein with a single rotational power source;

a head frame provided at one end of said shaver housing, said head frame being provided with three outer cutting members and three inner cutting members each rotatable inside one of said three outer cutting members, said three outer cutting members being provided with gear teeth thereon;

first drive means provided inside said shaver housing and rotated by said single power source so as to cause said three inner cutting members to rotate in one direction;

two rotation transmission means rotatably engaged with each other, one of said two rotation transmission means being rotated by said at least one first drive means; and second drive means provided inside said shaver housing and rotated by an other of said two transmission means so as to cause said three outer cutting members to constantly rotate 360° about a central axis of each one of said three outer cutting members in said one direction via said gear teeth provided on said three outer cutting members; and wherein said three outer cutting members rotate in a same direction and said three inner cutting members rotate in a same direction; and each of said three cutting members is independently depressible in a direction along said central axis of each of said three outer cutting members;

a relay gear means is provided on said head frame so as to mesh with said gear teeth provided on two of said three outer cutting members.

* * * * *

UNITED STATES PATENT AND TRADEMARK OFFICE

CERTIFICATE OF CORRECTION

PATENT NO. : 6,212,776 B1
DATED : April 10, 2001
INVENTOR(S) : Shunji Izumi et al.

It is certified that error appears in the above-identified patent and that said Letters Patent is hereby corrected as shown below:

Title page,
Item [73], Assignee change "Izuma Products Company, Nagano (JP)" to
-- Izumi Products Company, Nagano (JP) --

Signed and Sealed this

Twenty-seventh Day of August, 2002

*Attest:*

*Attesting Officer*

JAMES E. ROGAN
*Director of the United States Patent and Trademark Office*